US009409205B2

(12) United States Patent
Hakan

(10) Patent No.: US 9,409,205 B2
(45) Date of Patent: Aug. 9, 2016

(54) METHOD AND DEVICE FOR DOSING AND COATING

(75) Inventor: Karlsson Hakan, Saffle (SE)

(73) Assignee: MATTSSONFORETAGEN I UDDEVALLA AB, Uddevalla (SE)

( * ) Notice: Subject to any disclaimer, the term of this patent is extended or adjusted under 35 U.S.C. 154(b) by 0 days.

(21) Appl. No.: 14/002,742

(22) PCT Filed: Mar. 2, 2012

(86) PCT No.: PCT/SE2012/050243

§ 371 (c)(1),
(2), (4) Date: Oct. 4, 2013

(87) PCT Pub. No.: WO2012/118438

PCT Pub. Date: Sep. 7, 2012

(65) Prior Publication Data

US 2014/0023790 A1 Jan. 23, 2014

(30) Foreign Application Priority Data

Mar. 3, 2011 (SE) ..... 11501947

(51) Int. Cl.
*B05C 11/02* (2006.01)
*B05D 1/26* (2006.01)
(Continued)

(52) U.S. Cl.
CPC ..... *B05D 1/26* (2013.01); *B05C 1/0813* (2013.01); *B05C 5/00* (2013.01); *B05C 5/0254* (2013.01); *B05C 5/0262* (2013.01); *B05C 11/042* (2013.01); *B05C 1/083* (2013.01); *B05C 1/0834* (2013.01); *B05C 9/04* (2013.01); *B05C 11/02* (2013.01); *B05C 11/025* (2013.01); *B05C 11/1039* (2013.01)

(58) Field of Classification Search
CPC ..... B05D 1/26; B05D 1/28; B05C 11/02; B05C 11/025; B05C 11/042; B05C 11/1039; B05C 1/0813; B05C 1/083; B05C 1/0834; B05C 5/00; B05C 5/0254; B05C 5/0262; B05C 9/04
USPC ..... 118/300; 427/421.1, 428.14, 428.17
See application file for complete search history.

(56) References Cited

U.S. PATENT DOCUMENTS 3,706,508 A * 12/1972 Moskowitz et al. ..... 415/115
3,857,267 A * 12/1974 Lemaire et al. ..... 72/209
(Continued)

FOREIGN PATENT DOCUMENTS

| | | |
|---|---|---|
| CN | 101316662 | 7/2012 |
| EP | 0931878 | 7/1999 |
| WO | 2007061378 A1 | 5/2007 |

OTHER PUBLICATIONS

International Search Report and Written Opinion issued in PCT/SE2012/050243 on Jun. 20, 2012.
(Continued)

*Primary Examiner* — Alexander Weddle
(74) *Attorney, Agent, or Firm* — Jeffrey S. Melcher; Manelli Selter PLLC

(57) ABSTRACT

The present invention relates to an applicator arrangement comprising base support arrangement, a supply unit for supply of coating liquid/slurry, an applicator device, and a metering device, wherein said supply unit comprises a distribution pipe which is supported on said support body by means of a bearing arrangement arranged to enable axial expansion and contraction of said distribution pipe.

20 Claims, 8 Drawing Sheets

(51) Int. Cl.

| | |
|---|---|
| ***B05C 1/08*** | (2006.01) |
| ***B05C 5/02*** | (2006.01) |
| ***B05C 5/00*** | (2006.01) |
| ***B05C 11/04*** | (2006.01) |
| *B05C 9/04* | (2006.01) |
| *B05C 11/10* | (2006.01) |

(56) References Cited

U.S. PATENT DOCUMENTS

| | | | | |
|---|---|---|---|---|
| 4,316,428 | A | | 2/1982 | Flaum |
| 4,848,268 | A | | 7/1989 | Sollinger |
| 4,869,933 | A | | 9/1989 | Sollinger |
| 4,949,667 | A | * | 8/1990 | Yoshida et al. ..... 118/60 |
| 5,766,353 | A | | 6/1998 | Madrzak |
| 5,772,766 | A | * | 6/1998 | Reich et al. ..... 118/413 |
| 6,159,289 | A | | 12/2000 | Kurtz |
| 2001/0008118 | A1 | | 7/2001 | Bernert |
| 2003/0066638 | A1 | * | 4/2003 | Qu et al. ..... 165/186 |
| 2011/0265712 | A1 | * | 11/2011 | Hagedorn et al. ..... 118/118 |

OTHER PUBLICATIONS

Extended Search Report issued in European Patent Application No. 12752932.9, May 9, 2014, pp. 1-4.

Chinese Office Action issued in Chinese application No. 201280020729.4 on May 5, 2015, pp. 1-5.

* cited by examiner

METHOD AND DEVICE FOR DOSING AND COATING

FIELD OF THE INVENTION

The present invention relates to an applicator arrangement comprising base support arrangement, a supply unit for supply of coating liquid/slurry, an applicator device, and a metering device.

BACKGROUND INFORMATION

The so called blade coating technique is a prior art method for the coating of running webs. This technique that exists in lots of varieties is based on the principle that a coating medium (colour, starch for example) surplus is supplied at a surplus to the web at a position prior to a final dosing metering means. Said final dosing and metering means may be composed of structure combined with thin flexible blades, rigid blades or rods that, similar to puttying, doses out and applies the amount of coating medium, see for example WO 2007/061378 which is herewith incorporated by reference. The dosing and coating means are comprised in an applicator arrangement, which for instance comprises means for handling the surplus of the coating medium, which is returned for circulation and reuse by the arrangement. Prior art applicator arrangements present several disadvantages, e.g. having a bulky and relatively complex structure.

In US 2001/0008118 a coating device for directly or indirectly applying a coating medium onto a running paper- or boardweb is shown. The device includes nozzle lips of which at least one is being formed by a blade element. By applying an elastic nozzle lip, the nozzle gap can be enlarged. The coating device includes a mechanism for adjusting the height of the nozzle gap. A disadvantage with this design is that it designed as a separate unit implying difficulties in achieving a compact design of the whole application arrangement.

A related problem within the field of dosing and coating arrangements is that the coating medium mostly has to be supplied at a temperature that is different (normally higher) compared to ambient temperature, in combination with the fact that the total applicator arrangement is relatively large, i.e. extends over the cross machine width. As consequence there may result temperature gradients causing bending of the applicator arrangement, which may result in coat weight variations. According to prior art this problem is commonly handled by costly and bulky temperature control structures, e.g. as shown in EP 0 931 878. This prior art document describes a fountain coating applicator presenting an alternative manner of handling the latter problem, i.e. the tendency of heated coating to cause a temperature gradient is counteracted by cantilevering the applicator head on arms from a support beam through which a temperature-controlling fluid is circulated.

SUMMARY OF THE INVENTION

It is an object of the present invention to overcome or at least minimize at least one of the drawbacks and disadvantages described above, which is achieved by means of an arrangement and method according to the appended claims.

Thanks to a solution according to the invention there is provided an applicator arrangement which is very compact and does not require as much space as prior art technique does. Investment costs may be smaller and the accessibility of the arrangement makes maintenance and reparations easier and cheaper. According to a preferred embodiment this achieved by an applicator arrangement wherein means for distribution of coating medium and scraping off a surplus of coating medium are in the form of integrated units.

According to one aspect of the invention the applicator arrangement according to the invention comprises a supply unit for supply of coating liquid/slurry, an applicator device and a metering device, wherein said supply unit forms a support for at least one of said applicator device and/or metering device, and wherein at least one of said applicator device and/or metering device is directly or indirectly attached to said supply unit. Preferably said supply unit comprises a distribution pipe which in its turn is supported by a support body by means of a bearing arrangement arranged to enable axial expansion and contraction of said distribution pipe.

It is to be understood that said supply unit forms a support body for said applicator device and/or metering device in the sense that it receives forces transmitted from said applicator device and/or metering device upon operation. This means according to the invention at least a majority of the forces applied from the applicator device and/or metering device upon use are arranged to be spread to and distributed within the body which constitutes said supply unit.

Positive effects of synergy are obtained thanks to an applicator arrangement according to the invention, among others that a shorter flow passage is acquired between the supply unit and the mouth of the applicator device, i.e. in addition to the compactness of the arrangement also the radially shorter flow passage contributes to acquire an even flow of the coating medium.

According to another aspect of the invention the applicator device of the applicator arrangement comprises nozzle lips forming the gap for outlet of the coating medium.

According to yet another aspect of the invention both of said applicator device and said metering device are attached to said supply unit, which provides a very compact and easily maneuvered applicator arrangement.

According to still another aspect of the invention said supply unit is in the form of a distribution pipe or tube, preferably a circular tube of a metallic non welded design, more preferred a standard tube, which provides a much more cost-efficient pressure vessel than traditionally used supply vessels.

According to another aspect of the invention said supply unit is supported by a support body, wherein preferably said support body is made in a much cheaper material than the supply unit, e.g. a low alloy steel. Hereby manufacturing costs for an applicator arrangement according to the invention can be cut.

According to another aspect of the invention said supply unit is supported on the support body by means of bearing arrangement arranged to enable axial expansion and contraction of said supply unit, thereby eliminating the need of sophisticated tempering means to avoid bending of the body.

According to another aspect of the invention said supply unit is arranged to function without the use of any cooling housing, that otherwise would participate in the expansions/contractions of the supply unit, which makes the arrangement significantly less expensive and more easy to control.

According to another aspect of the invention said support body/base support arrangement is in the form of a tube, preferably made in a low cost steel material, which further leads to improve cost-efficiency.

According to another aspect of the invention said support body is arranged to contain circulating tempering liquid. Hereby is achieved a very efficient way of keeping an even temperature around and along the entire support body leading to that excellent precision is acquired when operating the coating machine.

According to another aspect of the invention the space for the circulation liquid within the support body is delimited by means in a body positioned within the interior of the support body to form said space between the inner surface of the support body and the exterior surface of the inner body. Hereby the needed volume of tempered medium is substantially reduced, and thereby also the total weight.

According to another aspect of the invention said delimited space is provided with sealing members enabling spiraling circulation which improves tempering within the support body.

According to another aspect of the invention said base support comprises a pivot arm arranged to enable pivoting between an active and inactive position of the applicator arrangement and wherein the active pivot axis of said pivoting arm is positioned within an area defined by the vertical tangents of the roll onto which the applicator arrangement is fixed, which improves the compactness.

According to yet another aspect of the invention, and thanks to the compact and space-saving arrangement according to the invention two applicator arrangements may be positioned at the periphery of one and the same roll, directly after each other. As a result of this a very well-covering coating of the surface of the running web may be achieved.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENTS

The following detailed description, and the examples contained therein, are provided for the purpose of describing and illustrating certain embodiments of the invention only and are not intended to limit the scope of the invention in any way.

Figure 1:
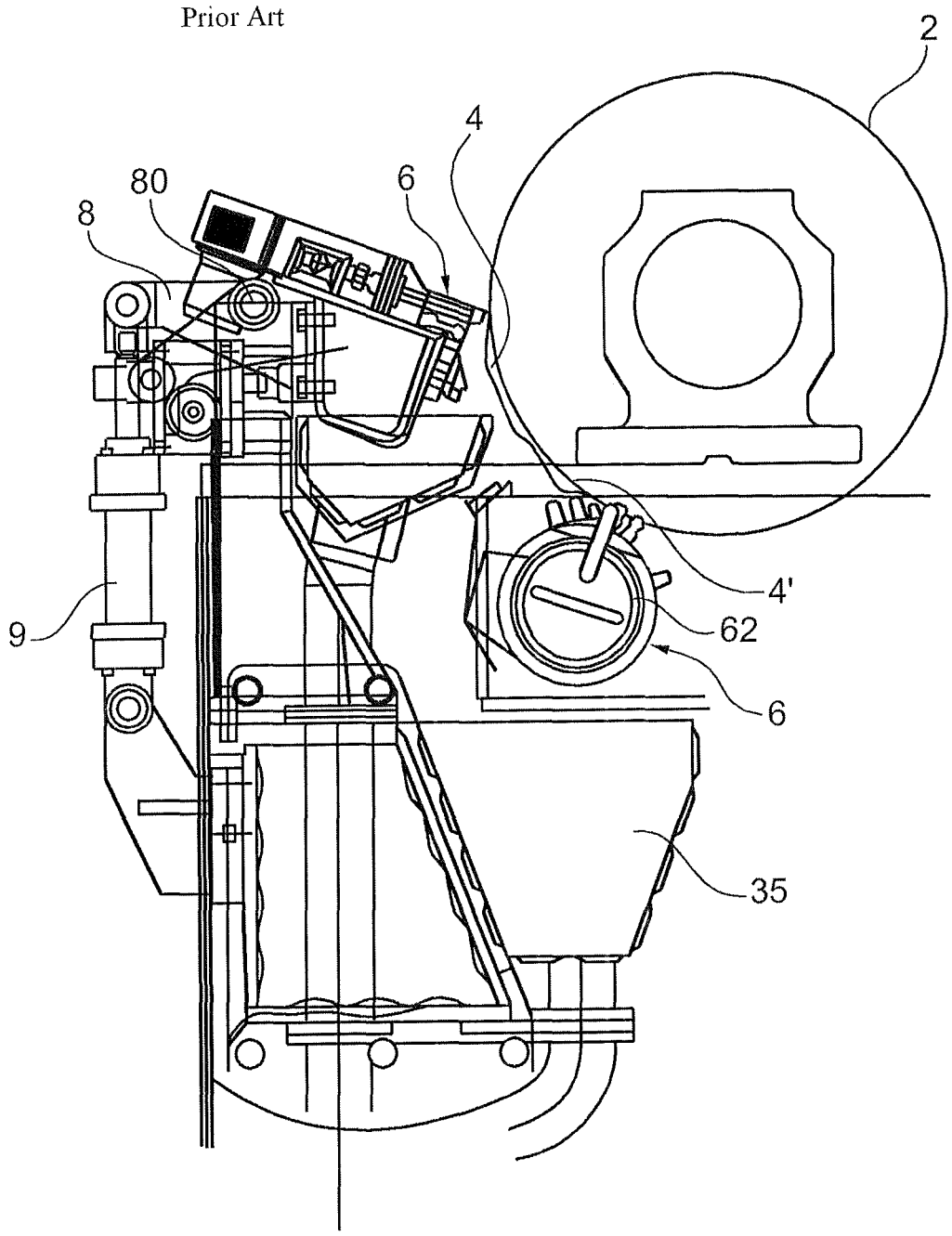
FIG. 1 shows a side view of a generally known prior art applicator arrangement.
Figure 2:
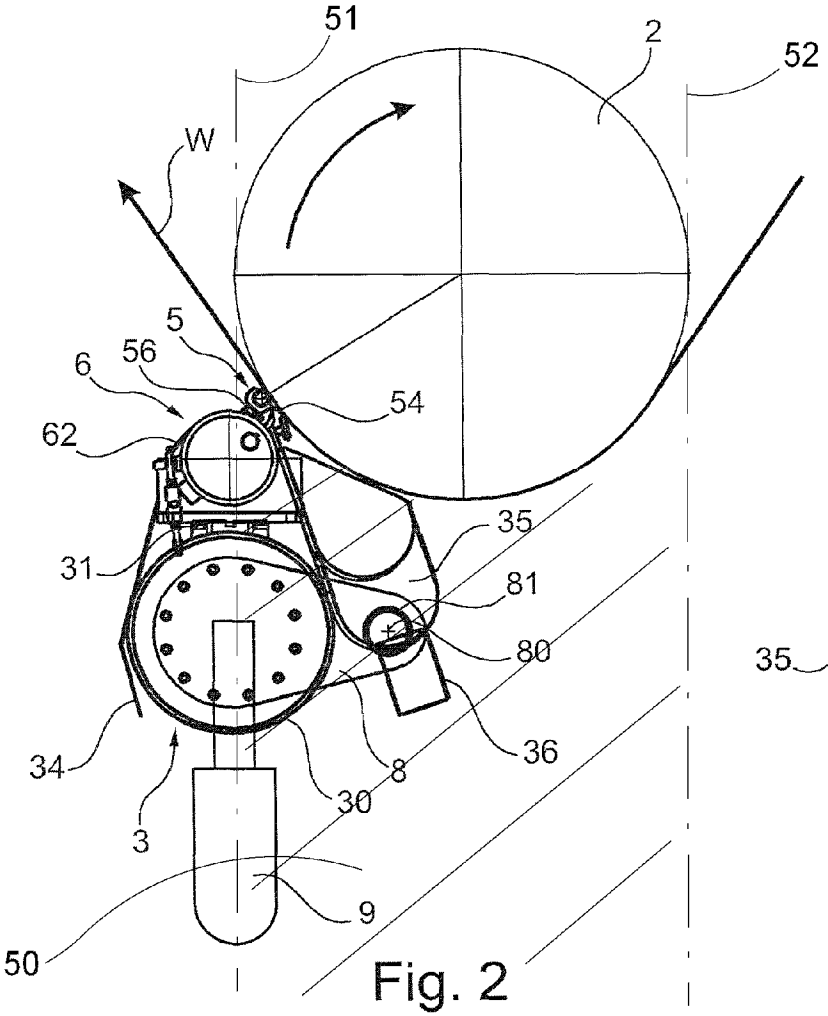
FIG. 2 shows a side view of a preferred embodiment of an applicator arrangement according to the invention, in use for one sided application.

In FIG. 1 there is schematically shown a side view of a prior art applicator arrangement. In FIG. 2 there is shown a corresponding side view of an applicator arrangement according to the invention, wherein the same reference signs have been used for corresponding parts/elements. As can be seen the arrangement according to the invention seen in FIG. 2 occupies a drastically reduced space compared to a prior art arrangement thanks to its beneficial design, as will be explained more in detail below.

The applicator arrangement will now be described referring mainly to FIGS. 2-6. According to one embodiment the applicator arrangement 1 according to the invention comprises a base support arrangement 8, 9, a supply unit 6 for supply of coating liquid/slurry 4, an applicator device 5 and a metering device 7. Said supply unit 6 comprises a distribution pipe 62 which forms a support for the applicator device 5 and metering device 7 in that at least one of said applicator device 5 and/or metering device 7 is directly or indirectly attached to said distribution pipe 62 so that, upon operation of the coating machine, at least 50% of the forces from the applicator device 5 and/or metering device 7 are received by the body of the distribution pipe 62.

Further, the distribution pipe 62 is supported by a support body 3 by means of a bearing arrangement 31 arranged to enable axial expansion and contraction of said distribution pipe 62. The support body 3 is mounted on a holding bracket comprising a pivot arm 8 which is pivotally arranged about a pivot axis 80, of a pivot axis 81, whereby said supply unit 6 may be moved towards or away from the backing roll 2. A cylinder 9 is arranged to make the holding bracket 8 movable. Together said holding bracket 8 and said cylinder 9 forms said base support arrangement 8, 9. The cylinder 9 may be affixed in many different ways. The pivot arm 8 is arranged to enable pivoting between an active and inactive position of the applicator arrangement 1, and the active pivot axis 80 of said pivoting arm 8 is positioned within an area 50 defined by the vertical tangents 51, 52 of the roll 2 onto which the applicator arrangement 1 is fixed. Thanks to arranging the pivot axis 80 of the bracket 8 in a region preferably underneath the roll 2, the lever arrangement and the whole movable unit becomes less space consuming.

In the example of FIG. 2 a backing roll 2 is supporting a running web W at its backside. The length of the backing roll 2 preferably at least corresponds to the width of the running web W, preferably longer than the length of said running web W. Adjacent the backing roll 2 there is arranged an supply unit 6 and an applicator device 5 according to the invention. Said supply unit 6, which extends the full width of the backing roll 2 in the cross machine direction, provides via a supply and distribution pipe 62 the running web W with a film 4 of a coating medium, as will be later described in more detail. Applied coating which is not retained on the web can be collected in a coating pan arrangement 35 and recirculated e.g. via an outlet pipe 36.

Figure 3A:
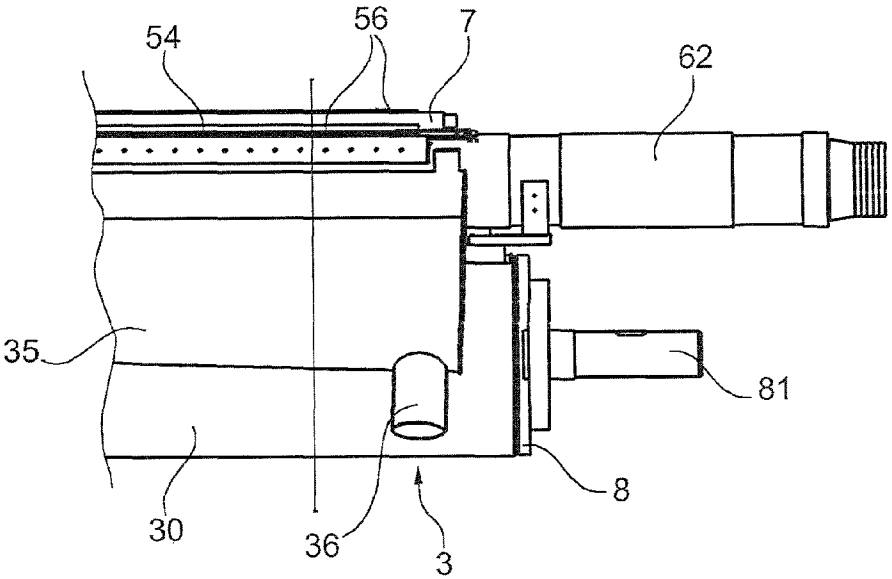
FIG. 3A-B show an applicator arrangement according to one embodiment from the right hand side of the applicator arrangement in FIG. 2.
Figure 3B:
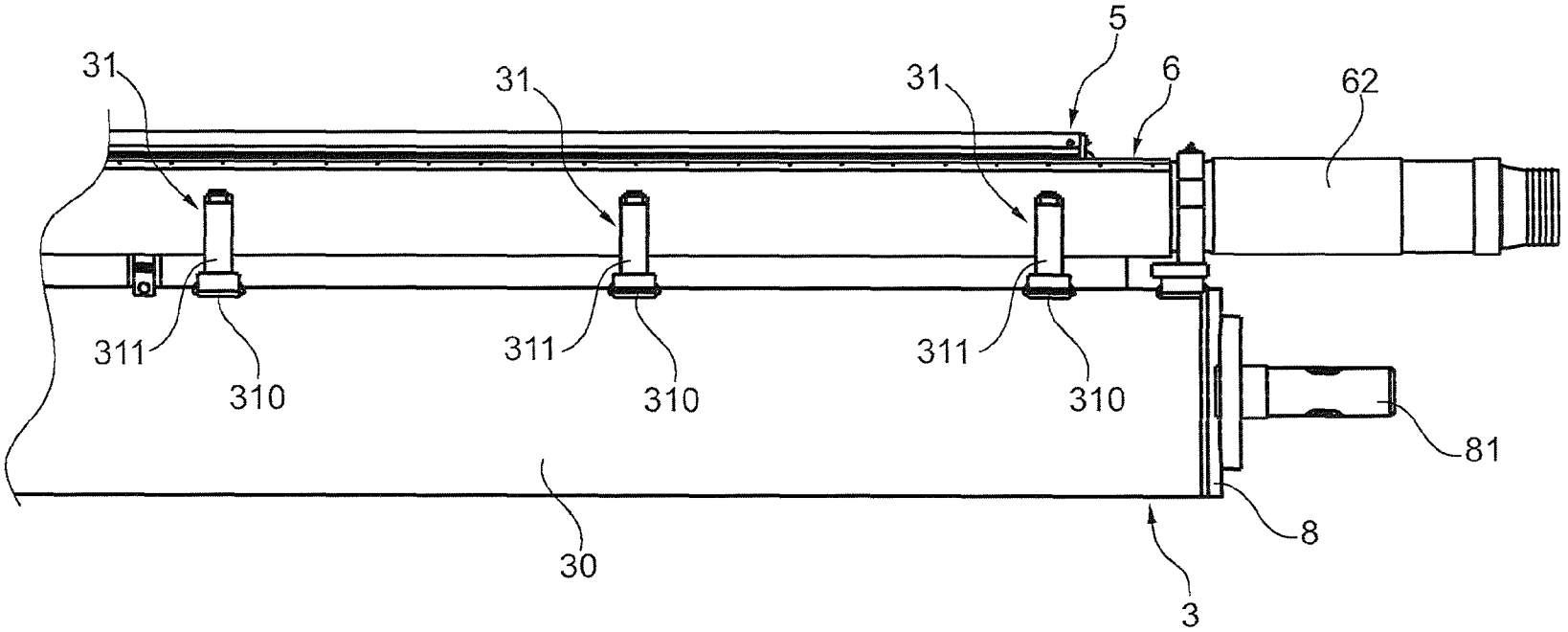

In FIGS. 3A-B the coating machine is shown from the right hand side, including a supply unit 6 as the one shown in FIG. 2, for direct application of a coating medium onto a running web W. FIG. 3A shows an end portion of a coating machine equipped with a coating pan arrangement 35 and an outlet pipe 36, whereas in FIG. 3B there is displayed bearings 31 arranged between the base support arrangement 3 and the supply unit 6. The supply unit 6 comprises a distribution pipe 62 through which coating medium 4 is supplied and distributed, wherein coating medium is distributed from the pipe 62 to e.g. a web W via an applicator device 5 comprising nozzle lips 54, 56 (see also FIG. 4) forming the gap 55 for outlet of the coating medium 4.

A support body 3, that supports the distribution pipe 62, forms a fixed stable structure together with distribution pipe 62 implying that there is no need of a temperature control arrangement to eliminate undesired tensions due to temperature changes (which can otherwise lead to bending=uneven coating). The support structure 3 may not be eliminated by making the distribution pipe 62 "self-supportive" due to the extremely expensive material thereof, which is needed due to the extreme demands, e.g. depending on the desire to minimize fall off of coating ejected from the nozzle gap 55, which is achieved by having the coating 4 supplied at high pressure. However, thanks to the novel concept the support body may be made in any suitable material/form that fulfills the desired need of providing stabile support, e.g. a standard low alloy steel tubing, which facilitates low cost production. Low alloy steel may be defined as a steel having a total of alloying elements, e.g. Ni, Cr and Mb, below 10%, preferably below 8%, and more preferred below 5%.

According to one embodiment, the distribution pipe 62 is slidable arranged in relation to the support structure 3, e.g. by providing a support base 30 with a bearing 31, which bearing 31 is arranged with a first low friction interface 310 arranged on the support base 30 and a second, mating, low friction interface 311 on the bottom part of the supply tube 62, to allow the distribution pipe 62 to freely slide due to heat expansion/contraction, thereby in an easy, cost-efficient and safe way safeguard a tension-free supply tube 62, i.e. eliminating the need of a cooling arrangement and eliminating a complex support structure 3.

As is illustrated in FIG. 3A an elongated metering device 7, also referred to as "metering element", is attached to said supply unit 6, wherein the length of the metering element 7 preferably corresponds at least to the width of the running web W. The structure of said metering element 7 as well its function will later be described in more detail (see for instance FIG. 4 and FIGS. 7-8). Preferably the distribution pipe 62 forms a support for the metering element 7, and the metering element 7 is attached to the supply unit 6 directly or indirectly. In one embodiment the metering element 7 is attached to, and held by a part of the applicator device 5, which in its turn is fixed onto the distribution pipe 62. Hereby the metering element 7 will be positioned very close to the gap 55 (see FIG. 4) defined by the applicator device 5 and formed by the nozzle lips 54, 56 through which the coating medium/slurry 4 is supplied from the pipe 62, leading to that both the coating and the metering of excessive slurry can be performed by means of one integrated unit (i.e. the applicator device 5 and the metering element 7), whereby the beneficial compactness of the applicator arrangement can be achieved.

Said applicator device 5 and/or metering element 7 are attached to the supply unit 6 directly or indirectly, meaning that at least a major portion of the forces created upon the metering element 7 being brought into contact with the underlying running surface are transmitted to and spread within the body of the distribution pipe 62. This leads to improved ability of withstanding applied stress and thereby also to an elongated life time of the equipment.

Figure 4:
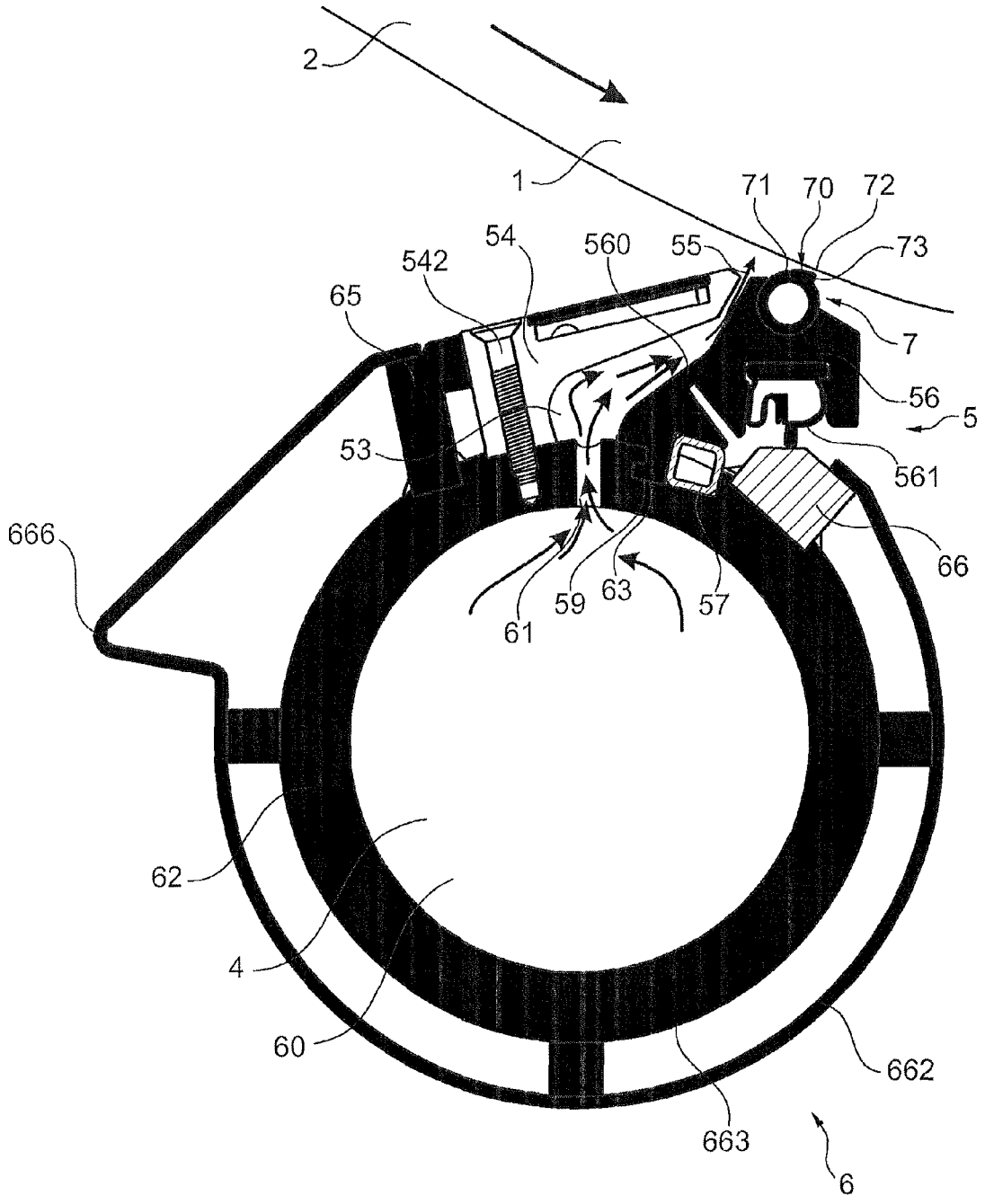
FIG. 4 shows a cross sectional transversal view of an embodiment of an applicator arrangement according to the invention, further provided with a cooling arrangement.

FIG. 4 shows a cross sectional transversal view of a first embodiment of a supply unit 6 according to the invention. The supply unit 6 comprises a distribution pipe 62, preferably made of metal, and which has an interior cavity 60. Said pipe 62 extends parallely along the roll 2, and continues further on at least one side where the inflow is arranged. The coating medium 4 is supplied into the interior cavity 60 of the pipe 62 from one (or both) end of said pipe 62 and flows through a plurality of radial through-holes 61 in the wall of the distribution pipe 62. The through-holes 61 are positioned as rows one of through-holes in 61 the axial direction of the distribution pipe 62 leading the medium 4 from the interior cavity 60 into a equalization chamber 53, on the outside of the tube 62. Said equalization chamber 53 is delimited on one side by an essentially solid element forming a fixed nozzle lip 54, which is firmly and securely mounted onto the distribution pipe 62 by screws 542. On the other side the chamber 53 is delimited by a holding body 56. Together the fixed nozzle lip 54 and the holding body 56 form a gap 55 where through coating medium 4 is supplied. In the present exemplifying description said fixed nozzle lip 54, holding body 56, equalization chamber 53 and gap 55 define the applicator device 5. A coating medium 4 is applied through the applicator device 5 when supplied from the pipe 62 onto an underlying running surface (e.g. a web W or a roll 2). The holding body 56 is provided with a foot 59 that fits into a matching groove 63 at the surface of the distribution pipe 62. The holding body 56 is firmly fixated onto the distribution pipe 62 by means of a flexible pressure tube 57. This arrangement provides a way of quickly exchanging said holding body 56, which is advantageous since such exchanging often needs to be done quite frequently, and a swift changing of parts means reduced downtime.

Other ways of attaching the holding body 56 are also possible, for instance by means of an interconnecting member (not shown) fixedly arranged on the pipe 62 which in its turn provides a fastening location for said foot 59. Such an interconnecting member may be attached onto the pipe 62 for instance by means of screwing, thereby replacing the need for producing said groove 63.

The coating medium 4 leaves the equalization chamber 53 through a gap 55 and is applied on the surface of a web W or a transfer roll or a gravure roll 22 (as will later be described). The nozzle lips 54, 56 form the gap 55 for outlet of the coating medium. By means of a flexible pressure member 561 and a hinge portion 560 the size of the gap 55 may be continuously controlled. According to one embodiment the holding body 56 is made in one piece and consists of an elastic material which leads to that it can be made to flex about the hinge portion 560 towards or away from an underlying surface, for instance by means of said flexible pressure member 561.

The holding body 56 is provided with a metering element 7 (see WO 2007/061378 where the use of the metering element 7 is described) arranged on the upper portion of said holding body 56. Said metering element 7 comprises a circular body which is pivotally arranged about its length axis. The metering element 7 is further provided with a ridge-formed metering portion 70 having a first meeting side 71, said side 71 being continuously curved, and a rear side 73 comprising an upright edge thereby forming an edge 72 between the meeting side 71 and the rear side 73.

In an arrangement using this metering element 7 the advantage is obtained that when no contact is wanted between the metering element 7 and the web or roll the metering element 7 is turned so that no contact longer exists between the metering portion 70 and the web or roll 1. This means that the supply unit 6 as a whole may remain in its position.

The embodiment shown in FIG. 4 includes a cooling arrangement, wherein the circumferential area of the distribution pipe 62 is surrounded by a plate 662, which is provided with a drop edge 666. Said plate 662 extends approximately 270°○ about the periphery of the distribution pipe 62. A spacing 663 is arranged between the plate 662 and the distribution pipe 62 and its extension about the periphery of the distribution pipe 62 corresponds substantially with the extension of the plate 662. This spacing may be filled with cooling medium, e.g. cooling water. To avoid cooling medium to leak out from the spacing 663 each end of said spacing 663 is provided with a tightening material 65, 66.

Figure 5:
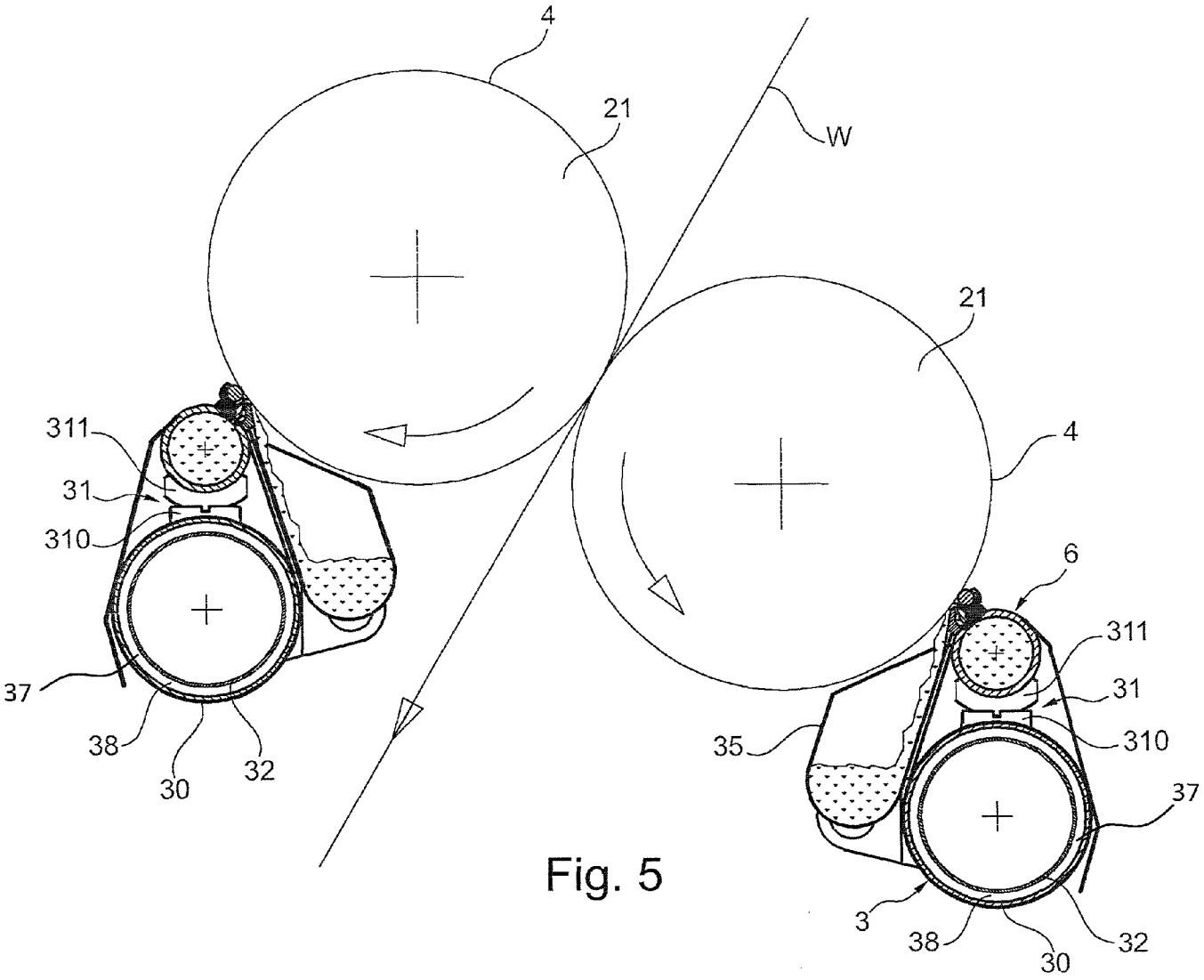
FIG. 5 shows a side view of an applicator arrangement as shown in FIGS. 2 and 3, in use for double sided application, by means of transfer rolls.

In FIG. 5 there is shown a perspective of a coating machine including a supply unit 6 according to the invention for indirect application of a coating medium onto a running web W. A transfer roll 21 is placed on each side of the running web W. Adjacent to the transfer roll 21 there is arranged said supply unit 6, providing the transfer roll 21 with a film 4 of coating medium which film is applied onto the running web W in a so called indirect application procedure of a coating medium 4 onto the running web W. Herein is also illustrated the bearing 31 between the support structure 3 and the distribution pipe 62, said bearing 31 comprising a first low friction interface 310 arranged on the support base 30 and a second, mating, low friction interface 311 on the bottom part of the supply tube 62. By means of the bearing 31 said distribution pipe 62 is slidable arranged in relation to the support structure 3.

The support structure 3 is delimited by means of a body 32 (e.g. an inner tube member) positioned within the interior of the support base 30 to form a space 38 between the inner surface of the support base tube 30 and the exterior surface of the inner body 32, said space 38 being arranged to provide for a flow of tempering liquid for acquiring an even temperature along and around the support base 30. In one embodiment said delimited space 38 may be provided with sealing members 37 enabling spiraling circulation within the support body 3 which further contributes to said acquiring of an even temperature without any temperature gradients. The sealing members 37 may for instance form a structure between the inner surface of the support base tube 30 and the exterior surface of the inner body 32 arranged to guide the passing flow of tempering liquid through the delimited space 38. For example such structure may be in the form of a helix extending along the support base 30 surface arranged to enable said spiraling circulation. According to one embodiment the sealing members 37 comprise O-ring members arranged around the circumferential inner surface of the support base tube 30 to form said helix surface structure leading to that a passing flow of tempering medium will be urged to circulate around the tube 30 while passing through the support unit 3.

Figure 6:
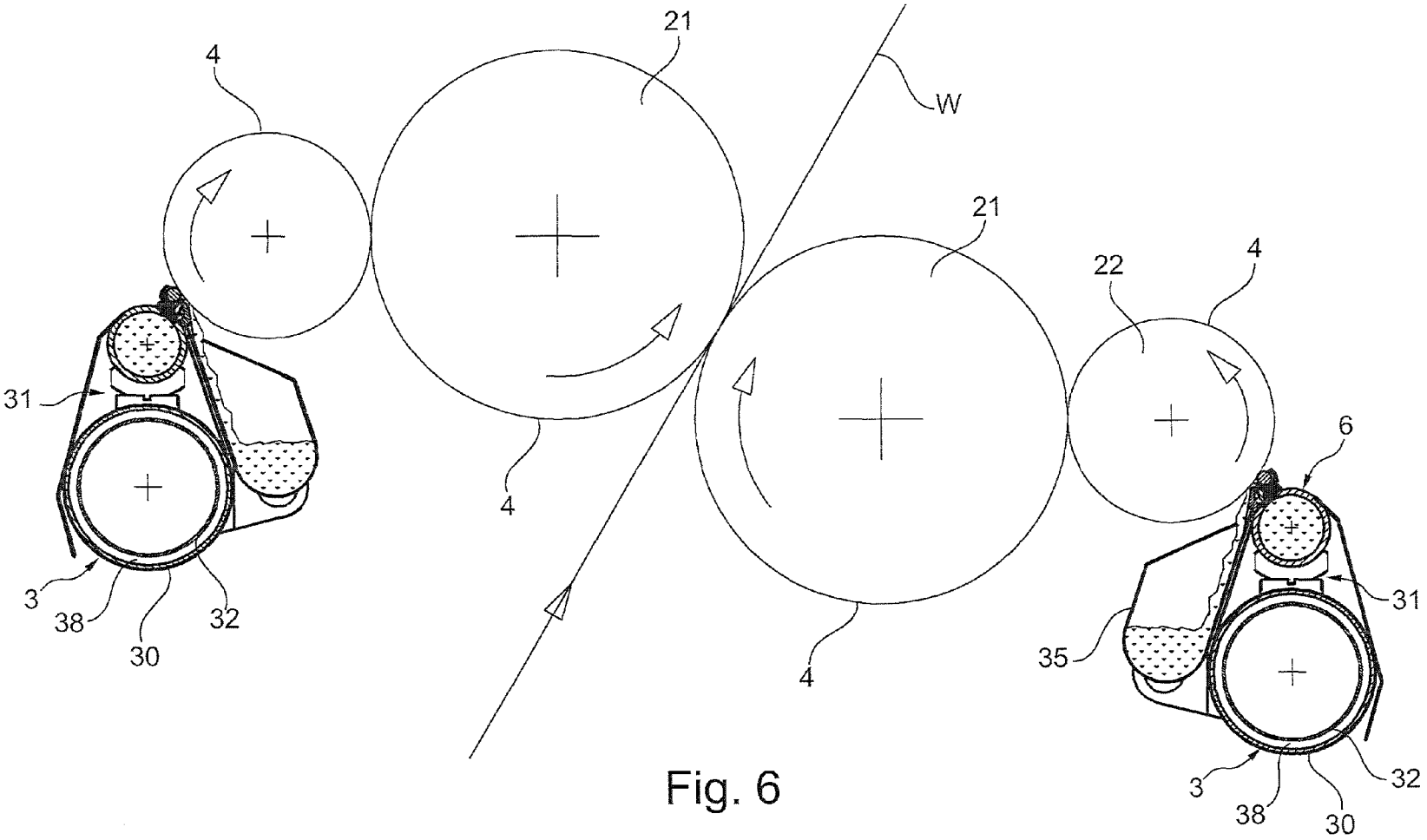
FIG. 6 shows a side view of an applicator arrangement as shown in FIGS. 2 and 3, in use for double sided application, by means of gravure rolls.

Also in FIG. 6 there is shown an example of an indirect application procedure using an applicator arrangement according to the present invention. Herein a gravure roll 22 is positioned along the transfer roll 21 so that the longitudinal axes of the rolls, respectively, are substantially parallel to each other. The length of the gravure roll 22 corresponds to the length of the transfer roll 21, said length of the rolls being at least as long as the width of the running web W, preferably longer than the length of said running web W. Adjacent the gravure roll 22 there is arranged said supply unit 6. Said supply unit 6, which extends the full width of the gravure roll 22 in the cross machine direction, provides the gravure roll 22 with a film 4 of a coating medium, said film 4 being applied to the transfer roll 21 and further, finally, to the running web W.

Figure 7:
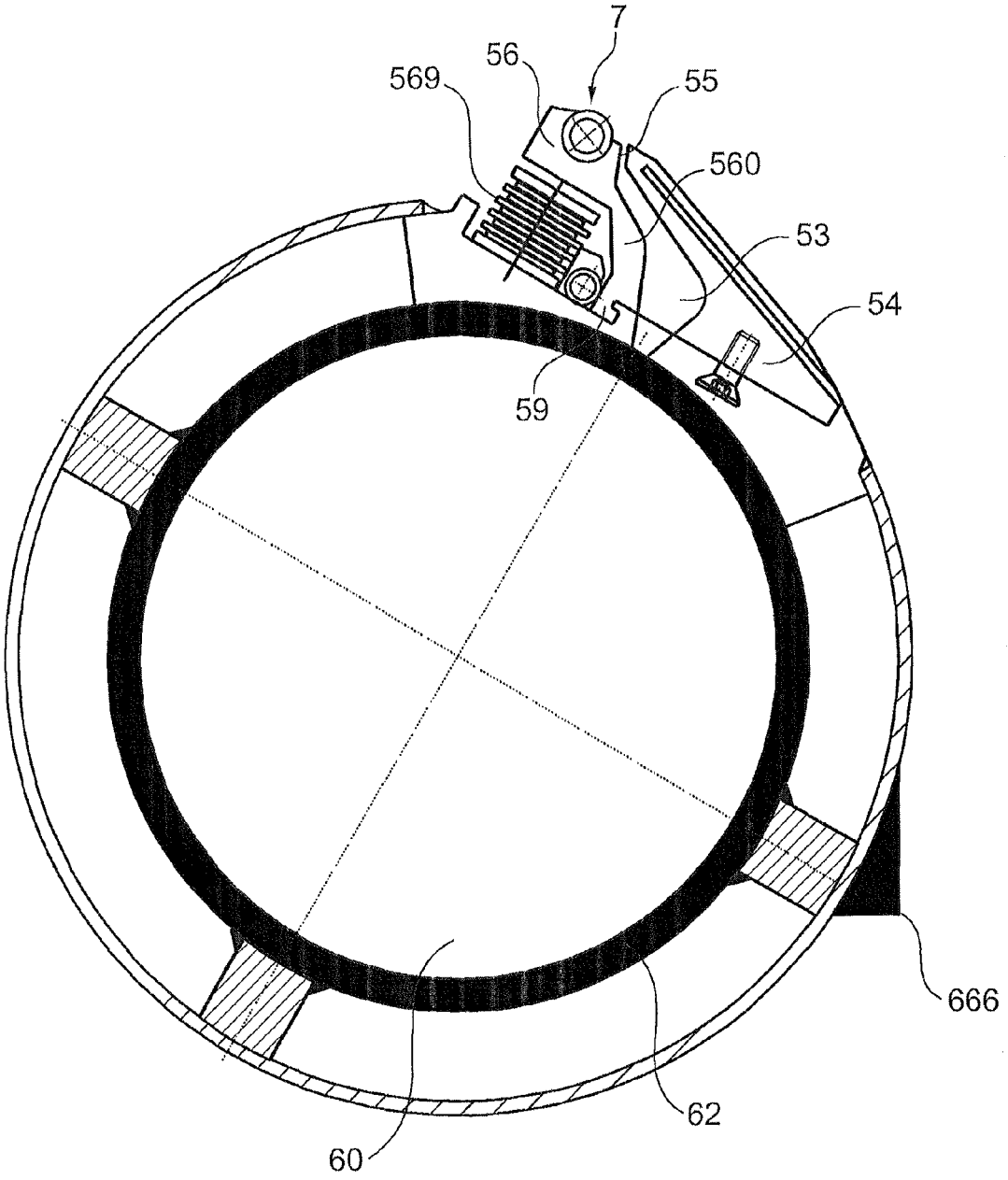
FIG. 7 shows a cross sectional transversal view of a second embodiment of an applicator arrangement according to the invention.

FIG. 7 depicts an additional embodiment of a supply unit 6 of the present invention where the pressure tube 561 is replaced by a plurality of distributed pressure bellows 569. Said pressure bellows 569 are positioned with appreciate spacing so as to apply either a uniform pressure on the envelope surface of the holding body 56 or a pressure that varies along the envelope surface, which may be desired in some situations.

Figure 8:
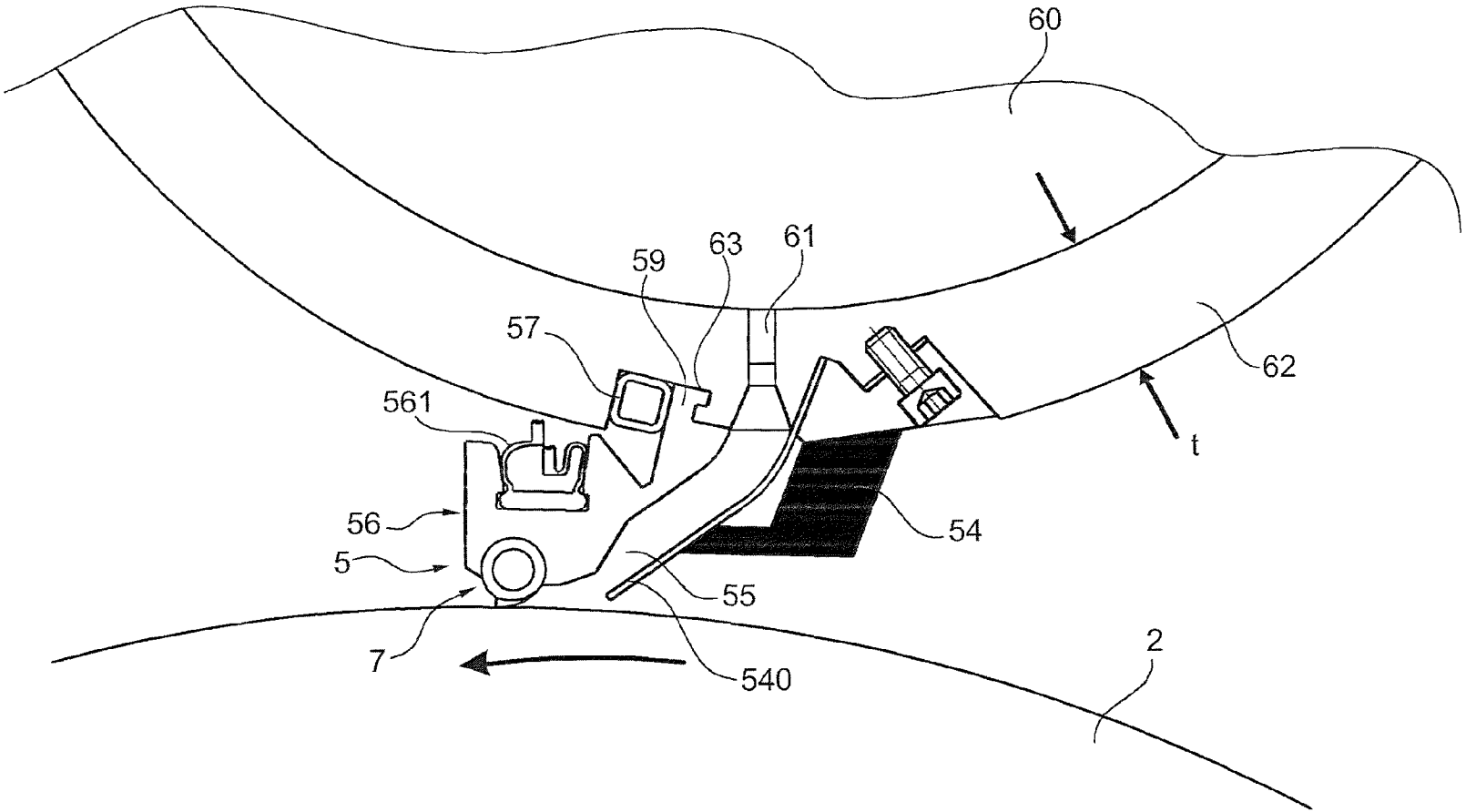
FIG. 8 shows a cross sectional transversal view of a third embodiment of an applicator arrangement according to the invention.

FIG. 8 shows a cross sectional transversal view of a preferred embodiment of a supply unit 6 according to the invention, wherein no cooling arrangement is used. Similarly to previously described embodiments an applicator device 5 comprising a fixed nozzle lip 54 and a holding body 56 is attached onto the supply unit 6 in the form of a distribution pipe 62. Coating medium 4 is arranged to flow through the distribution pipe 62 and via through-holes 61 in the wall of the distribution pipe 62 for further passage between the fixed nozzle lip 54 and holding body 56 of the applicator device 5 and is thereafter supplied onto the running roll 2 via the gap 55.

In the embodiment illustrated in FIG. 8 the fixed nozzle lip 54 is co-acting with a resilient blade 540 which is attached onto the distribution pipe 62 next to the fixed nozzle lip 54 at the side of the fixed nozzle lip 54 which faces the through passage for coating medium and the gap 55.

Preferably the thickness t of the distribution pipe 62 wall is even around the pipe circumference, preferably between 5-30 mm, even more preferred between 10-20 mm. In a preferred embodiment the wall thickness t is at least large enough for allowing fastening of said holding body 56 which, as previously described, may be attached onto the supply unit 6 by means of a groove 63 at the surface of the distribution pipe 62.

Coating Medium

Mixture of a fine plate-like mineral, typically clay or particulate calcium carbonate; coloring agents, typically titanium dioxide for a white sheet; and a binder which may be of the organic type or of a synthetic composition. Another type of coating medium may be an aqueous solution comprising e.g. starch used in sizing applications.

As will be understood by those skilled in the present field of art, numerous changes and modifications may be made to the above described and other embodiments of the present invention, without departing from its scope as defined in the appending claims. For example a metering rod can be used instead of the metering element 7.

It is understood that the objects of the present invention set forth above, among those made apparent by the detailed description, shall be interpreted as illustrative and not in a limiting sense. Within the scope of the following claims the set-up of various alterations of the present invention may be possible, for instance that said holding body 56 may be attached onto the supply unit 6 via an interconnecting member (not shown) that may be attached onto the distribution pipe 62 surface, e.g. by means of screwing. Further it is evident for the skilled person that many other forms (than tubular) and material (than low alloy steel) may be used to design the support body 3, e.g. in the form of traditional beams, e.g. I-beam, etc. and by using other materials, e.g. plain carbon steel (with or without lining), polymeric materials (e.g. with reinforcement), concrete (e.g. with reinforcement), etc.

The invention claimed is:

1. Applicator arrangement comprising:

a supply unit for supply of coating liquid/slurry;

an applicator device constructed to apply the coating liquid/slurry to a running web; and a metering device constructed to meter an amount of the liquid/slurry being supplied to the applicator device from the supply unit, wherein said supply unit comprises:

a support body;

a distribution pipe constructed to deliver the coating liquid/slurry to the applicator device and metering device, the applicator device and metering device being supported by the distribution pipe; and a bearing slidably connecting the distribution pipe to the support body so that the distribution pipe can slide in relation to the support body enabling axial expansion and contraction of the distribution pipe during delivery of the coating liquid/slurry, the distribution pipe being separate from support body, wherein the applicator device and the metering device being solely connected to the support body only by the distribution pipe and bearing so that the support body supports the distribution pipe, the applicator device and the metering device.

2. The applicator arrangement according to claim 1, wherein at least a portion of an outer surface of the distribution pipe is exposed to ambient air.

3. The applicator arrangement according to claim 1, wherein a greater portion of an outer surface of the distribution pipe is exposed to ambient air than a portion of an outer surface of the distribution pipe not exposed to ambient air.

4. The applicator arrangement according to claim 1, wherein said distribution pipe is arranged to function without being connected to a cooling housing that would participate in the expansion or contraction of the supply unit.

5. The applicator arrangement according to claim 1, wherein said support body is in the form of a tube of a low alloy steel material.

6. The applicator arrangement according to claim 1, wherein said support body is in the form of a tube.

7. The applicator arrangement according to claim 6, characterized in that said support body is arranged to contain circulating tempering liquid.

8. The applicator arrangement according to claim 7, wherein a space for the circulation liquid within the support body is delimited by means of a body positioned within the interior of the support body to form said space between the inner surface of the support body and the exterior surface of the inner body.

9. The applicator arrangement according to claim 8, wherein said delimited space is provided with sealing members enabling spiraling circulation within the support body.

10. The applicator arrangement according to claim 1, wherein said support body is made in a low alloy steel material.

11. The applicator arrangement according to claim 1, wherein said support body is made in a low alloy steel material having a tubular form.

12. The applicator arrangement according to claim 1, wherein said distribution pipe forms a support body for the metering device, wherein the metering device is directly or indirectly attached to said distribution pipe.

13. The applicator arrangement according to claim 12, wherein said metering device is indirectly attached to said distribution pipe via an interconnecting member.

14. The applicator arrangement according to claim 1, wherein said distribution pipe is in the form of a tube.

15. The applicator arrangement according to claim 1, wherein said distribution pipe is in the form of a circular tube of a metallic non welded design.

16. The applicator arrangement according to claim 1, wherein said distribution pipe is in the form of a tube.

17. An applicator arrangement comprising:

a supply unit for supply of coating liquid/slurry;

an applicator device constructed to apply the coating liquid/slurry to a running web;

a metering device constructed to meter an amount of the liquid/slurry being supplied to the applicator device from the supply unit, wherein said supply unit comprises:

a support body;

a distribution pipe constructed to deliver the coating liquid/slurry to the applicator device and metering device, the applicator device and metering device being supported by the distribution pipe; and a bearing slidably connecting the distribution pipe to the support body so that the distribution pipe can slide in relation to the support body enabling axial expansion and contraction of the distribution pipe during delivery of the coating liquid/slurry, the distribution pipe being separate from support body, wherein the applicator device and the metering device being solely connected to the support body only by the distribution pipe and bearing so that the support body supports the distribution pipe, the applicator device and the metering device; and a base support arrangement comprising a pivot arm connected to the support body and being arranged to enable pivoting between an active and inactive position of the applicator device, and wherein an active pivot axis of said pivoting arm is positioned within an area defined by vertical tangents of a roll onto which the applicator arrangement can be fixed.

18. The applicator arrangement according to claim 17, wherein the thickness of said distribution pipe is between 5-30 mm.

19. The applicator arrangement according to claim 17, wherein the thickness of said distribution pipe is between 10-20 mm.

20. A method for supply of coating liquid/slurry onto a running surface, comprising providing an applicator arrangement according to claim 1; and supplying the coating liquid/slurry onto a running web from the applicator device.

* * * * *